United States Patent [19]

Sutherland

[11] 4,323,164

[45] Apr. 6, 1982

[54] LOCKING SYSTEM FOR A TRAIN CAR COUPLER

[76] Inventor: Ben E. Sutherland, Rte. 2, Cherokee Dr., Seymour, Tenn. 37865

[21] Appl. No.: 122,580

[22] Filed: Feb. 19, 1980

[51] Int. Cl.[3] ..... B61G 3/06

[52] U.S. Cl. ..... 213/145; 213/139

[58] Field of Search ..... 213/139, 145–148, 213/115, 117, 118, 122, 123, 125, 126

[56] References Cited

U.S. PATENT DOCUMENTS 2,909,293 10/1959 Metzger ..... 213/146

*Primary Examiner*—Randolph A. Reese

*Attorney, Agent, or Firm*—Luedeka & Fitch

[57] ABSTRACT

A locking system for a railway car coupler includes a gravity lock member which defines a slot and a lock-lifter which includes a trunnion extending through the slot, terminating at a distal end. A flange is secured to the trunnion at the distal end. The flange prevents disengagement of the trunnion from the slot unless a predetermined orientation is achieved.

6 Claims, 7 Drawing Figures

LOCKING SYSTEM FOR A TRAIN CAR COUPLER

The present invention relates to railway coupling mechanisms and more particularly to a locking system for such couplers.

Railway cars are provided with coupling mechanisms at each end for interchangeable coupling with other cars to form trains. Because of the manner in which rail cars are mixed throughout trains, it is very important that couplers be uniform in design, size, etc. so as to accommodate interchange of rolling railroad stock. Uniform standards have been set for couplers by the Association of American Railroads.

For example, A.A.R. Standard E couplers include a pivoted knuckle which is maintained in position by a gravity lock in the coupler housing. That is, the lock member is vertically movable within the housing and is maintained in the lower, or locked, position by gravity. A locklifter assembly is suspended between the lock member and the coupler housing. A movable lever engages the assembly to apply an upward force to raise the lock member to an upper or unlocked position.

The locklifter assembly includes three mutually pivotable members: a toggle member, a rotor member and a hub member. The hub member is hook-shaped, adapted to pivotally engage a shift mounted upon the coupler housing. The rotor member is pivotally attached to the hub member by a rivet. The toggle member is pivotally attached to the rotor member by another rivet and pivotally attached to the lock member by means of an integral trunnion on the rotor member which is, in turn, pivotally received in a slot defined in the lock member. The pivotal movements of those several members, and particularly the toggle member are guided by reason of their fit within the coupling housing. The toggle member in particular is designed to fit relatively closely within an appropriate opening in the coupling housing to prevent lateral displacement thereof relative to the lock member. Such close fit severly limits conventional connections between the toggle member and the lock member.

Coupling mechanisms are subjected to extraordinarily harsh operating conditions. As the railway cars are pulled over thousands of miles of rails, in varying conditions of disrepair, the cars are bounced and rocked in all directions. Adjacent cars are frequently bounced in opposite directions at the same time. As a result, the couplng mechanisms are subjected to tremendous vibrations as well as intermittent forces from all directions. Although hardened cast steel or forged steel is commonly used for the coupler mechanisms, the natural result of the vibrations and forces is that the bearing surfaces of the interconnected members of the locklifter assembly are gradually worn away, regardless of the quality of the material used.

As the material at the bearing surfaces is worn away, wobbling occurs at each of the pivotal locations, i.e., at the rivets, the trunnion and the shaft. Eventually, the combination of all of the wobbling and just the right bounce or other force frequently causes the locklifter assembly to disengage from the lock member and dangle from the housing shaft.

Once the locklifter assembly is disengaged from the lock, the force of the lever cannot be applied to the lock member through the assembly. The locklifter assembly cannot be simply reconnected to the lock member because, as noted above, "just the right bounce" is required. However, the lock member cannot be raised manually because it is quite dangerous for an operator to reach into a locked coupler of a train in the field. A slight motion of a railway car can seriously injure or destroy a hand caught in the coupler housing. Consequently, the two involved railway cars, which are frequently bound for different destinations, are locked together until the coupler can be dismantled to unlock the couplers.

If the disengaged locklifter is discovered in a train yard, the two locked cars are separated from the rest of the train and sent to the repair shop where the defective coupler is dismantled, unlocked, and then re-assembled. In the meantime, the locked cars are waiting, either empty or full, for a period which may range from hours to days. The lost time provides no economic return to the railroad and may work a considerable hardship to the shipper. In the case of perishable goods, the result can be disastrous.

If the locklifter disengages in the field, the losses are magnified. Either the entire train must wait while the coupler is unlocked manually, a dangerous practice, or else the locked cars must be left at a destination where at least one car does not belong.

As noted hereinabove, the coupler locking systems are subjected to extremely harsh conditions. Therefore, any variations in the standard couplers must be capable of withstanding the harsh conditions. In addition, the alterations in construction must not interfere with the connections between the altered coupler and any other standard coupler.

It is therefore an object of the present invention to reduce the amount of rail car time loss because of locked couplers. It is also an object to provide a locklifter which resists disengagement from a lock member. It is a further object to provide a locking system which can withstand the extreme forces applied to a coupler during operation. It is a still further object to provide a locking system which does not adversely affect the operation of the coupler.

Other objects and advantages will be apparent when the following description is considered in connection with the drawings in which.

Generally, in the depicted embodiment of the present invention, the lock member of the coupling mechanism is modified to reduce the thickness of the end thereof which is slotted to receive the trunnion for pivotal connection to the toggle member, and the trunnion on the toggle member is provided with an elongated terminal flange, i.e. on the outboard end of the trunnion, which is shaped to pass through the elongated slot with only slight clearance when the elongated dimension of the flange is in register with the elongated dimension of the slot. Such registration can only occur when the lock and toggle members are at least partially disassembled, i.e. partially outside the coupling housing. The angular orientation of the flange with respect to the operational attitude of the toggle member when it is fitted in the coupling housing is selected to be about 10 degrees with respect to the longitudinal axis of the toggle member so that the flange is rotated out of register with the slot in the lock member, thereby preventing withdrawal of the trunnion from such slot.

Figure 1:
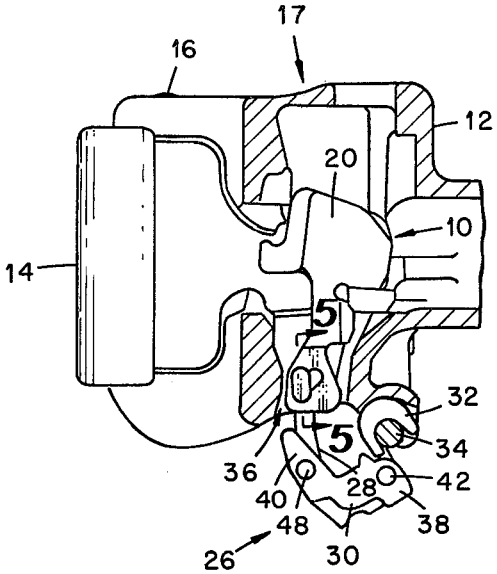
FIG. 1 is a partially sectioned elevational view of a coupler including a locking system embodying various of the features of the present invention.
Figure 2:
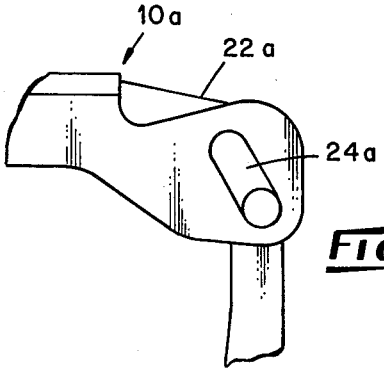
FIG. 2 is a fragmentary elevational view of prior locking system.
Figure 3:
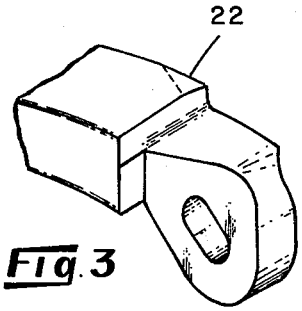
FIG. 3 is a fragmentary perspective view of the lock member of the locking system shown in FIG. 1.
Figure 4:
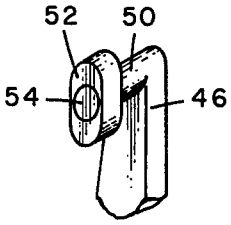
FIG. 4 is a fragmentary perspective view of a toggle member of the locking system shown in FIG. 1.
Figure 5:
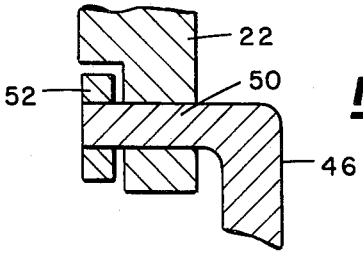
FIG. 5 is a cross-sectional view taken along line 5—5 of FIG. 1.

Referring more specifically to the drawings, a gravity lock member 10 is disposed within a standard coupler housing 12 and adapted for sliding vertical motion within the housing 12. The lock member 10 is slidable between an upper, or unlocked, position and a lower, or locked, position. In the upper position, the knuckle 14 is free to pivot about the pivot pin 16 and engage a knuckle of another standard coupler 17. The lock member 10 is free to drop into the lower position only when the knuckle 14 is pivoted into an engaged position, as shown in FIG. 1. When the lock member 10 occupies the lower position, the knuckle 14 is prevented from rotating out of the engaged position.

When the knuckle 14 is mounted upon a fully assembled coupler 17, the lock member 10 is primarily restricted to vertical motion. Only when the coupler is partially dismantled is the lock member 10 withdrawable from the housing 12, by orienting it generally horizontally for passage through a laterally directed aperture 18 in the housing 12.

The body portion 20 of the lock member 10 is unchanged from the prior art. Therefore, no modification of the housing 12 or knuckle 14 is required in order to practice the present invention. Moreover, the locking system of the present invention does not interfere with the connection of the coupler 17 with a coupler which includes a prior art locking system.

The lower end portion 22 of the lock member 10 defines an elongated slot 24, having a major dimension of about 1.5 inch and a minor dimension of about 0.75 inch. In accordance with the present concept, the lock member portion 22 is modified by reducing its thickness from about 1½ inch to a thickness of about one inch. Although this reduction in bulk does reduce the resistance to lateral stresses by the lock member 10, the forces applied to the lock member in the portion 22 around the slot 24 are primarily vertical in direction. The lateral stresses which do occur are of limited magnitude. Therefore, although the bulk of the lock member 10 is reduced in the portion 22, the resulting drop in stress-resistance is not of particular concern. The narrowed portion 22 remains strong enough for the stresses which occur.

The lock member 10 may be originally cast to provide a lower end portion 22 of reduced thickness. Alternatively, a prior lock member **10*a* may be modified by removing a portion of the lower end portion 22*a* in the area surrounding the slot 24*a* as by grinding. In addition, existing forging molds are easily modified by filling in a portion of the mold, thereby permitting the lock member 10** to be made with a minimal modification cost.

The pivotal locklifter assembly 26, comprising a toggle member 28, a rotor member 30 and a hub member 32, is suspended between a housing shaft 34 and the lock member lower end portion 22. The shaft 34 is secured to the housing 12 adjacent to the lower passageway 36 through which the portion 22 extends.

The standard E-type hub member 32, which is hook-shaped, is journalled on the shaft 34 and suspends therefrom. The standard E-type rotor member 30, having a first end 38 and a second end 40, is pivotally attached to the hub member 32 by means of a rivet 42 which defines a pivotal axis parallel to the shaft 34. The rotor member 30 is adapted to receive a standard E-type rod member (not shown) to apply upwardly directed pressure through the toggle member 28 to lift the lock member 10 and release the knuckle 14.

The toggle member 28 is elongated, having a first end portion 44 and a second end portion 46. The first end portion 44 is pivotally attached to the rotor member 30 by means of a rivet 48. The rivet 48 defines a pivotal axis which is perpendicular to the longitudinal axis of the toggle member 28 and parallel to the pivotal axis of the rivet 42. The second end portion 46 includes an integral trunnion 50 which extends from the end portion 46, perpendicular to the longitudinal axis of the toggle member 28 and parallel to the pivotal axis of the rivet 48.

The trunnion 50 is cylindrical, having a diameter of about 0.75 inch and a length of about 1.5 inch. The trunnion 50 is adapted for sliding and pivotal motion within the slot 24 of the lock member 10. In the present invention, the trunnion need not be altered when the toggle member 28 is engaged with the lock member 10, which has been modified by reducing the thickness of its end portion **22*a*, the trunnion 50 extends through, and beyond, the slot 24 by a distance of about one-half inch. Thus, the trunnion does not extend beyond the slot 24 to the point of interference with vertical motion by the lock member 10 within the housing 12**.

The present invention provides an elongated flange 52 that is secured at the distal end 54 of the trunnion 50, perpendicular to the longitudinal axis of the trunnion 50. In one embodiment, the flange 52 is provided with a central hole into which the distal end of the trunnion is received and the two are joined as by welding. The flange 52 is shaped essentially like the geometry of the slot 24 and sized slightly smaller than the opening defined by the slot 24 in both the major and minor dimensions, such that the flange 52 will pass through the slot 24 while traveling in a direction perpendicular to the plane defined by the flange 52. However, the oval shape provides that there are only two relative orientations of the lock member slot 24 and flange 52 which permit withdrawal of the trunnion 50. The two orientations are diametrically opposed so that the toggle member 28 must rotate 180° between release orientations.

In the standard lock member **10*a*, the slot 24*a* is arranged such that the major dimension of the slot 24*a* forms an angle of about 40° with the horizontal when the lock member is in a vertical orientation, i.e. whenever the coupler 17 is fully assembled. Although there are two possible orientations of the toggle member 28 which permit the withdrawal of the trunnion 50 through the slot 24, in fact neither orientation is achievable when the coupler 17 is fully assembled. As shown in FIG. 1, the housing 12 prohibits the toggle member 28 from rotating more than about 90° around the pivotal axis of the trunnion 50. That is, when the coupler is fully assembled, pivotal motion by the toggle member 28 is limited by direct contact with the housing 12 at points A and B. Between points A and B there is no point at which the flange 52 permits withdrawal of the trunnion 50 from the slot 24**.

The flange 52 has a thickness of about one-quarter inch. As noted hereinabove, the trunnion extends beyond the slot 24 by a distance of about one-half inch. Thus, the length of the trunnion 50 between the flange 52 and the second end portion 46 is about one-quarter inch greater than the thickness of the lower end portion 22 adjacent the slot 24, thus the forces applied to the flange 52 and the resulting wearing effects are minimized.

Figure 6:
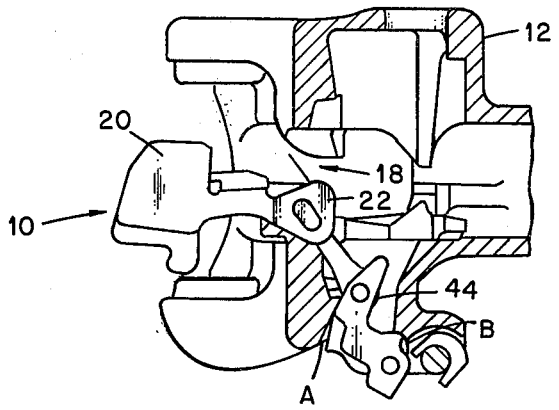
FIG. 6 is a partially sectioned elevational view of a partially dismantled coupler including a locking system embodying various of the features of the present invention.
Figure 7:
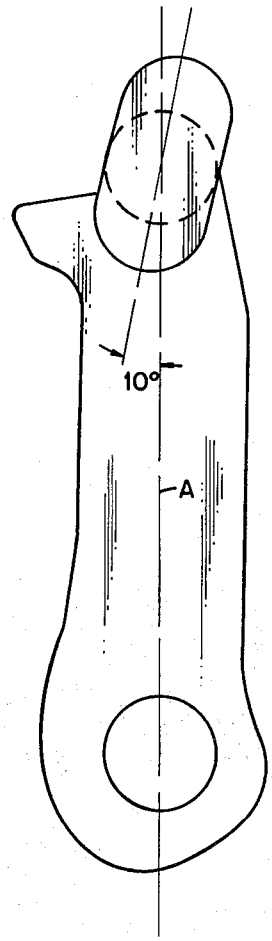
FIG. 7 is a representation of a toggle member embodying various features of the present invention.

As shown particularly in FIG. 6, when a coupler 17 is dismantled, after the knuckle 14 is removed, the lock member 10 is drawn laterally through the passageway 18. As the lock member 10 is drawn through the passageway 18, the connected toggle member 28 is drawn into the housing 12. When the lock member 10 reaches the partially withdrawn position shown in FIG. 6, the flange 52 is properly oriented to permit withdrawal of the trunnion 50 from the slot 24. The lock lifter assembly 26 is disengagable from the member 10 only in this position.

A locking system in accordance with the present invention is assembled in the same manner as prior locking systems. That is, the locklifter assembly 26 is mounted upon the housing 12 by engaging the shaft 34 with the locked hub member 32. Then the toggle member 28 is inserted through the passageway 36 of the housing 12 to engage the lock member 10 as it is inserted through the passageway 18. The lock member 10 and toggle member 28 are oriented as shown in FIG. 6 to permit complete passage of the flange 52 through the slot 24. The lock member 10 is then fully inserted into the housing 12, rotating the slot 24 relative to the trunnion 50 and the flange 52. The lock member 10 assumes a vertical orientation in the housing 12 and remains in that orientation while the coupler 17 is fully assembled. As noted above, the locklifter assembly 26 and the housing 12 prevent the toggle member 26 from rotating to a disengaging position.

Regardless of the amount of wearing and resultant wobbling at the rivets 42 and 48 and the shaft 34, the flange 52 prevents the trunnion 50 from disengaging from the slot 24. Thus, an operator can always release the lock member 10 without reaching into the housing 12 and there is a substantial reduction in the time lost by non-functioning locklifters. Moreover, there is not a noticeable loss in the strength and stress resistance of the locking system.

While a preferred embodiment has been shown and described herein, it will be understood that there is no intention to limit the invention by the disclosure, but rather, it is intended to cover all modifications and alternate constructions falling within the spirit and scope of the invention as defined in the appended claims.

What is claimed:

1. In a locking system for a railway car coupler including a gravity lock member defining a slot and locklifter means including a trunnion extending through said slot and terminating at a distal end, said trunnion being freely pivotable within said slot the improvement comprising elongated flange means centrally secured to said trunnion at said distal end, said flange means preventing withdrawal of said trunnion from said slot unless a predetermined orientation therebetween is achieved, said predetermined orientation being achievable only when said coupler is in a partially dismantled condition.

2. A locking system as defined in claim 1 wherein said slot is non-cylindrical and said flange is of the same general shape as the cross-sectional shape of said slot.

3. A locking system as defined in claim 1 wherein said slot and said flange are generally oval in cross-section and the major and minor dimensions of said flange are less then the respective major and minor dimensions of said slot.

4. A locking system as defined in claim 1 wherein the length of said trunnion is greater than the sum of the thickness of said gravity lock member at said slot and the thickness of said flange.

5. A locking system as defined in claim 1 wherein said flange is integral with said trunnion.

6. A method for preventing undesirable disengagement of a locking system for a train car coupler, said locking system including a gravity lock member defining a slot and locklifter means including a trunnion extending through said slot and terminating at a distal end, said method comprising:

(a) reducing the thickness of said lock member adjacent to said slot by removing a portion of said lock member adjacent to said slot, and (b) centrally attaching an elongated flange at said distal end of said trunnion, said flange having a shape similar to the shape of the cross-section of said slot and a thickness of less than the thickness of said removed portion of said lock member, whereby said trunnion is withdrawable from said slot only when said flange is placed in a predetermined orientation relative to said slot, said predetermined orientation being achievable only when said coupler is in a partially dismantled condition.

* * * * *